United States Patent [19]

Straubel

[11] 4,434,777

[45] Mar. 6, 1984

[54] FUEL SUPPLY APPARATUS FOR INTERNAL COMBUSTION ENGINES

[75] Inventor: Max Straubel, Stuttgart, Fed. Rep. of Germany

[73] Assignee: Robert Bosch GmbH, Stuttgart, Fed. Rep. of Germany

[21] Appl. No.: 392,486

[22] Filed: Jun. 28, 1982

[30] Foreign Application Priority Data

Jul. 11, 1981 [DE] Fed. Rep. of Germany ..... 3127419

[51] Int. Cl.[3] ..... F02B 47/08

[52] U.S. Cl. ..... 123/568; 123/445; 123/458; 123/459; 123/464

[58] Field of Search ..... 123/445, 446, 458, 459, 123/464, 510, 514, 568

[56] References Cited

U.S. PATENT DOCUMENTS

| | | | |
|---|---|---|---|
| 2,984,231 | 5/1961 | Cummins | 123/445 |
| 4,043,304 | 8/1977 | Stumpp et al. | 123/510 |
| 4,187,822 | 2/1980 | Craven et al. | 123/450 |
| 4,205,645 | 6/1980 | Eheim | 123/445 |
| 4,240,395 | 12/1980 | Simko et al. | 123/445 |
| 4,248,193 | 2/1981 | Choma et al. | 123/568 |

FOREIGN PATENT DOCUMENTS

| | | | |
|---|---|---|---|
| 2425000 | 1/1980 | France | 123/459 |
| 2062754A | 5/1981 | United Kingdom | 123/446 |

*Primary Examiner*—Ira S. Lazarus
*Assistant Examiner*—Magdalen Moy
*Attorney, Agent, or Firm*—Edwin E. Greigg

[57] ABSTRACT

A fuel supply apparatus for internal combustion engines is proposed, which has a fuel injection pump for supplying a regulatable fuel injection quantity, a ventilation apparatus for the fuel injection pump, a fuel quantity meter and a means of exhaust gas recirculation controlled by fuel quantity. A ventilation valve responding to a predetermined pump interior pressure is included in an overflow line in order to cool the fuel injection pump by connection with the fuel supply container. The fuel quantity meter is embodied as a spring-loaded piston-type fuel quantity meter and has a travel receptor which generates an electrical output signal and delivers it to a control member of the exhaust gas recirculation system for varying the recirculated exhaust gas quantity accordingly.

9 Claims, 5 Drawing Figures

FUEL SUPPLY APPARATUS FOR INTERNAL COMBUSTION ENGINES

BACKGROUND OF THE INVENTION

The invention is based on a fuel supply apparatus for internal combustion engines having a fuel injection pump which includes a predetermined interior pressure for supplying a regulatable fuel injection quantity, a ventilation apparatus for the fuel injection pump and an exhaust gas recirculation means controlled by said fuel quantity. In such fuel injection pumps, it is known to perform a cooling of the distributor pump and thus of the fuel pumped by it and delivered to the injection valves, and at the same time to control the recirculation of exhaust gas from the exhaust tube to the intake tube in accordance with the quantity of fuel delivered to the injection pump or consumed by the injection pump in delivering it to the injection valves, this control being such that a sufficient quantity of fresh air for satisfactory combustion is always available to the engine. The supply of the fuel can be regulated by volumetric metering, and a maximum of power can be attained by means of this regulation without exceeding the limits for the maximum permissible toxic component of the exhaust gas.

In this connection, it is known also to associate heat exchangers with the distributor injection pump, and temperature sensors may generally be provided, which deliver fuel used for cooling purposes to a separately provided cooler of the distributor injection pump by way of separate fuel lines. The exhaust gas recirculation system associated with such fuel supply apparatus is usually regulated mechanically, and it may be designed such that a throttle valve in the intake tube progressively closes the mouth of the exhaust recirculation line, the more the throttle valve opens up in order to increase the fresh-air component. The adjustment of the throttle valve may be controlled via a hydraulic motor by a comparative regulating device, which ascertains an actual value for the quantity of fresh air delivered to the engine, perhaps with the aid of a baffle valve, and compares this value with the fuel quantity delivered to the distributor injection pump, this comparison being effected with the aid of a differential valve. In so doing, a so-called exhaust gas test range is defined with respect to the engine rpm, and within this range the recirculation of exhaust gas takes place, frequently being variably controlled in its magnitude; at very high engine rpm, outside the test range, it is desirable to shut off the recirculation of exhaust gas. This is often accomplished by means of a suitable control of the exhaust gas recirculation quantity in accordance with the fuel quantity supplied by the fuel injection pump. The disposition of a cooler with the associated lines for the distributor pump is complicated, however, and it is expensive both in terms of engineering effort and cost; the same disadvantages apply to regulating the exhaust gas recirculation quantity with the aid of the comparison device including a differential valve.

OBJECT AND SUMMARY OF THE INVENTION

The fuel supply apparatus according to the invention has the advantage over the prior art that the quantity of recirculated exhaust gas can be adapted in a particularly simple manner and without any perceptible delay at least to the quantity of fuel effectively consumed by the engine, and furthermore the fuel temperature can be regulated such that it assumes a substantially constant value, and the disposition of a cooler with the associated lines for the distributor injection pump is no longer necessary.

Effective cooling of the pump is attained particularly in the critical range, that is, at relatively high rpm and outside the exhaust gas test range. The discharge quantity is returned directly to the fuel supply container, and at the same time the fuel quantity meter disposed in the inlet of the pump ascertains a maximum fuel quantity consumption and suppresses the recirculation of exhaust gas, preferably completely. Any discharge quantity from the distributor injection pump then occurring is returned directly to the fuel supply container. The injection pump is thus always cleanly ventilated whenever such predetermined operational ranges exist; in other words, it is in any event cleanly ventilated from time to time.

A further advantage is attained in that by reducing or completely suppressing the recirculation of exhaust gas above a maximum engine rpm within the exhaust gas test range, a predetermined quantity of fuel is merely flushed through the distributor injection pump but is not consumed thereby --that is, it is not delivered to the injection valves; on the other hand, however, this apparent (but not actual) increase in the fuel quantity causes the fuel quantity meter in the inlet to the injection pump to ascertain operating conditions which effectively influence the exhaust gas recirculation quantity. The engine is thus soiled to a lesser extent; at a low rpm range, the result is a stabilization of the fuel temperature.

By means of the characteristics delineated hereinafter, further advantageous embodiments of and improvements to the fuel supply apparatus disclosed are attainable. It is particularly advantageous that any possible nonlinearities in the spring-loaded piston type of fuel quantity meter disposed in the inlet of the injection pump, which may be caused by spring stiffness and by the travel receptor as described extensively herein are compensated for by means of a nonrectangular and in any case nonlinear realization of the slit, through the opening cross section of which the fuel passes to the pump inlet. Every time before the engine is started, a zero-point correction of the travel receptor can be performed in the fuel quantity meter. It is furthermore advantageous that during overrunning, above a lower idling rpm threshold, the ventilation line can likewise be returned directly into the tank. It is furthermore possible to trigger magnetic valves by means of special pressure switches having an electrical output variable, while corresponding positions of the arbitrarily actuated driving pedal and operating states of the starter and of a thermal switch which may also be included can also be taken into consideration during starting and while the engine is still cold.

The invention will be better understood and further objects and advantages thereof will become more apparent from the ensuing detailed description of preferred embodiments taken in conjunction with the drawings.

DESCRIPTION OF THE PREFERRED EMBODIMENTS

Figures 1, 1A:
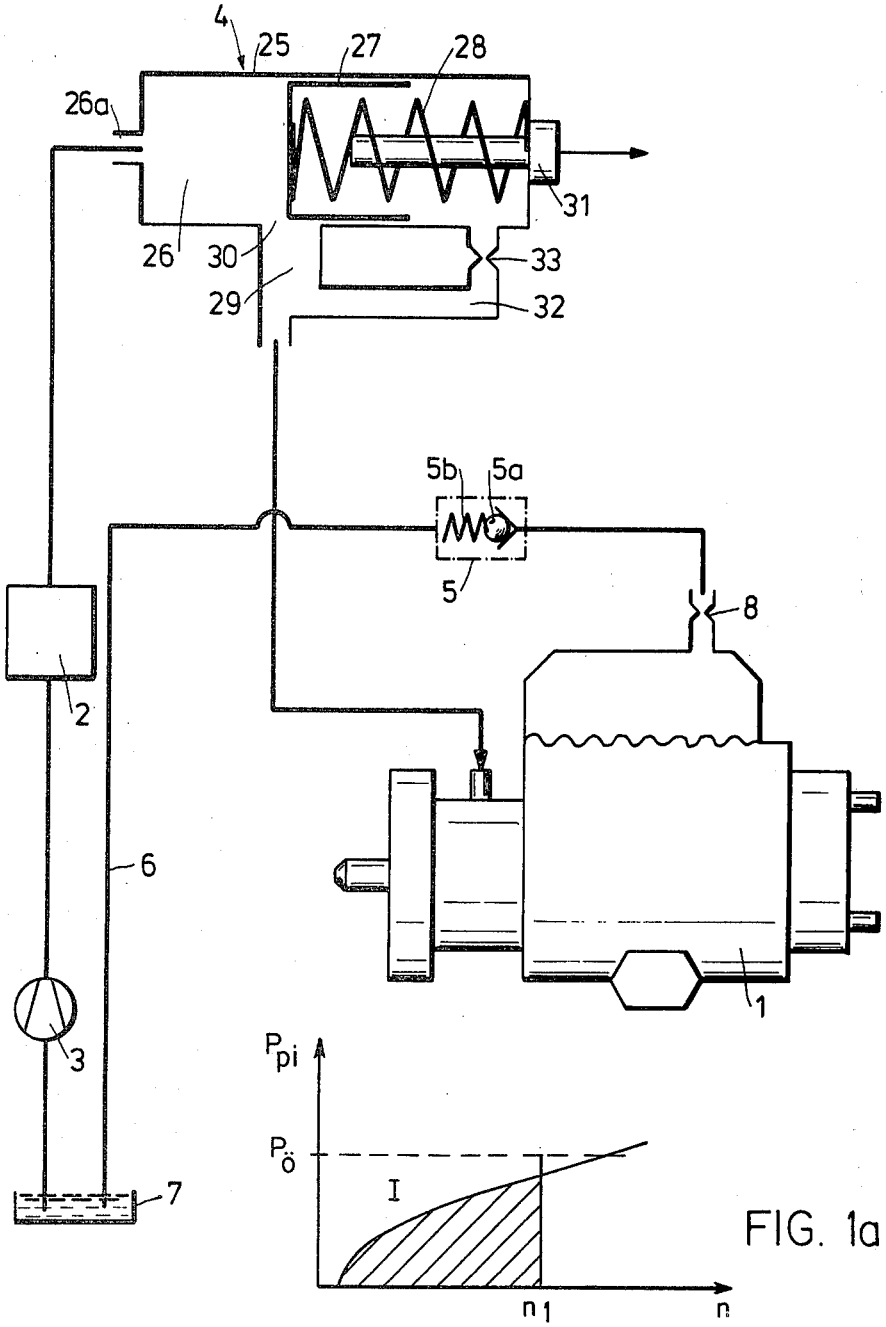
FIG. 1 shows a first exemplary embodiment of a ventilation, in accordance with operating states, of a fuel injection pump having a fuel quantity meter in the pump inlet.
FIG. 1*a* shows the dependency of the pump interior pressure on the engine rpm.
Figure 4:
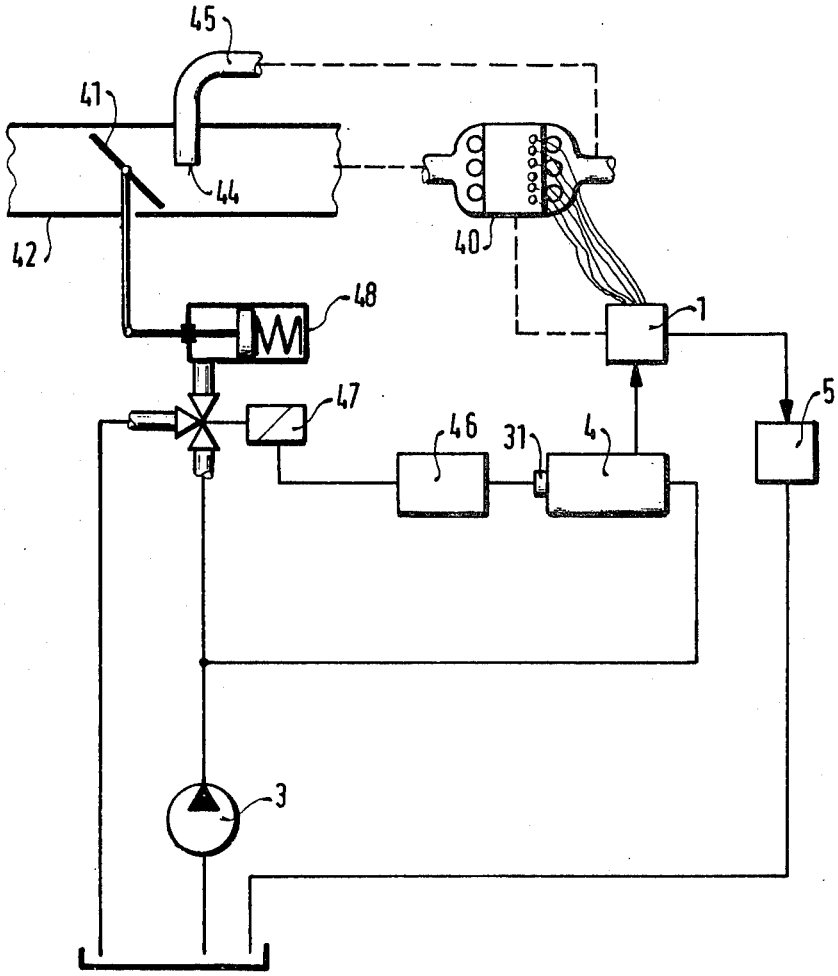
FIG. 4 shows schematically the relationship of the ventilation apparatus for the fuel injection pump to an exhaust gas recirculation means controlled by a regulatable fuel injection quantity.

Referring now to the first exemplary embodiment of the invention shown in FIG. 1 and to the system diagram of FIG. 4, the fuel injection pump is identified as 1; in order to supply fuel to an internal combustion engine 40 schematically shown. The pump is supplied with fuel via a filter 2 and a fuel supply pump 3, which may also be a presupply pump or may even be omitted entirely, if a fuel supply pump is integrated with the fuel injection pump itself. The fuel injection pump may be a series injection pump of known type, and in a known manner the fuel to be supplied to the engine is withdrawn from the suction chamber of the injection pump during the intake stroke of the injection pump pistons. The fuel quantity not required during the injection stroke of the pump pistons, for instance in the partial-load range, is returned to the suction chamber, and particularly the fuel located in the suction chamber is warmed up thereby. Between the filter 2 and the pump inlet, a fuel quantity meter 4 is generally provided as well, being part of the mixture regulator. The mixture regulator determines the mixture composition, based on the fuel quantity supplied by the fuel injection pump 1 or delivered to the pump 1 and ascertained by the fuel quantity meter 4, and in accordance with the fuel quantity the mixture regulator is capable of opening a throttle valve 41 in the intake tube 42 and also, simultaneously if necessary, closing an inlet opening 44 of an exhaust gas recirculation line 45 into the intake tube.

Because it is inserted between the filter 2 and the pump, the fuel meter whose outlet communicates with the pump inlet measures the total quantity of fuel delivered to the pump and is embodied as a spring-loaded piston fuel meter. It includes a cylinder 25, which may simultaneously embody the outer housing of the fuel quantity meter if needed; the cylinder 25 and the piston together define a work pressure chamber 26, whose inlet **26*a* in the exemplary embodiment shown here communicates via the filter 2 and a possibly provided presupply pump 3 with the fuel supply container 7. The piston 27, supported in the cylinder 25 such that it is slidably displaceable, is prestressed by a spring 28; depending on the quantity of fuel delivered to the distributor injection pump 1, this piston 27 together with an opening 29 in the cylinder 25 forms a flowthrough slit 30 of variable width. The distance traveled by the piston, varying as the slit width varies in accordance with the quantity of fuel passing therethrough, is ascertained by a travel receptor 31 and converted into a suitable signal which is preferably proportional to the fuel quantity. For recirculating fuel which has flowed along the piston wall to the back of the piston, a return line 32 is provided which discharges into the outlet opening 29 of the cylinder 25 and may also contain a damping throttle 33**, if needed.

The fuel quantity determined by this fuel quantity meter 4, which corresponds to the fuel quantity delivered to the distributor injection pump 1, then serves as a standardizing signal for the exhaust gas recirculation system, and in a manner which is at first arbitrary it influences the exhaust gas quantity once again returned to the intake tube at a particular time or else suppresses the recirculation of the exhaust gas entirely.

The travel receptor 31 is preferably a mechanical-/electrical system, which converts the piston displacement at a particular time into an electrical signal, for instance into an alternating-current signal of variable frequency, a direct-current signal which increases as the travel distance increases, or the like. If the travel receptor 31 also has an alternating-current output, then by way of example it may include an oscillator with a coil in a known manner, the coil armature of which is displaced in accordance with the piston travel, resulting in a corresponding variation in frequency. To this end, arbitrary converter systems 46 can be used which are known per se and whose structure does not need to be described in detail here, so long as they are capable of converting a physical input variable, specifically a variation in travel distance, into an electrical output variable.

In order to adjust the recirculated exhaust gas quantity, the output signal of the fuel quantity meter 4 can then be delivered to a magnetic valve 47, for example, which proportionately subjects a hydraulic control motor 48 to the system pressure in such a manner that the throttle valve 41 disposed in the intake tube 42, for example, is pivoted such that upon relatively extensive opening of the throttle valve in order to increase the supply of fresh air, a simultaneous covering over of the mouth of an exhaust gas recirculation line into the intake tube is effected, this being proportional to the measured fuel quantity.

However, it is also possible to use any desired manner of control motor for driving a mechanical baffle, for example, in the exhaust gas recirculation line, the motor using the output signal, which is proportional to the fuel quantity, of the travel receptor 31 of the fuel quantity meter and effecting a corresponding baffle position relating to the quantity of fuel supplied to the distributor injection pump. Instead of a mechanical baffle of this kind in the exhaust gas recirculation line, it is also possible to have a magnetic valve or some means which successively close off the mouth of the exhaust gas recirculation line into the intake tube. Finally, it may be useful in accordance with an advantageous embodiment of the invention to embody the exhaust recirculation system such that if a predetermined fuel quantity is exceeded, the exhaust gas recirculation is always interrupted. To this end, a threshold value transducer may be included following the travel receptor and parallel to the control apparatus; if a measured fuel quantity resulting when the engine is operating outside the exhaust gas test range is exceeded, the recirculation of exhaust gas is suppressed entirely by this threshold value transducer, for example by means of generating a parallel signal and delivering it to a barrier valve in the exhaust gas recirculation line.

The following embodiments relate to the field of the distributor injection pump and to the cooling of this pump. The course shown in the diagram of FIG. 1*a* indicates in qualitative fashion the dependency of the pressure $p_{pi}$-in the interior of the pump over the engine rpm n. The shaded area up to rpm $n_1$, below curve I, represents the exhaust gas test range, or the CVS test range. In the diagram of FIG. 1*a*, $p_{\ddot{o}}$ indicates the opening pressure of a mechanical ventilation actuator switch 5, which is embodied as a valve and disposed in the discharge of the injection pump; a relief line 6 leads from the ventilation actuator switch 5 to the fuel supply tank 7. The ventilation actuator switch 5 is preferably embodied as a simple check valve and then includes a ball 5*a* as its valve member, which is pressed by a spring 5*b* with a predetermined force against a seat; an overflow throttle 8 may also be disposed in the inlet leading to the ball pressure valve. The opening pressure $p_{\ddot{o}}$ of the ventilation valve thus embodied, which may also be a pressure regulator of any desired embodiment, is in any event adjusted such that it is above the pump interior pressure $p_{pi}$ developed at the maximum rpm $n_1$ in the exhaust gas test. Thus, if the engine supplied with fuel by the fuel injection pump 1 is driven at an rpm, for instance in the full-load range, at which the ventilation valve opening pressure $p_{\ddot{o}}$ is equal to or smaller than the pump interior pressure then prevailing at that rpm, then the ventilation valve opens; the result is an effective cooling of the pump in this critical range, because the pump is now supplied additionally with cool fuel from the fuel supply container 7, which is used as a heat exchanger, namely that quantity of fuel which returns to the fuel supply tank 7 via the ventilation valve.

At the same time, a mechanism is achieved in this connection and in combination with the regulated recirculation of exhaust gas which causes the mixture regulator to reduce or entirely suppress the exhaust gas recirculation quantity. In fact, the fuel quantity meter 4 in the pump inflow now measures even a larger fuel quantity than is effectively consumed by the engine, so that a larger fresh-air component is established by the mixture regulator as well, while the recirculated exhaust gas quantity is reduced or blocked. This all takes place in an rpm range above the highest rpm in the exhaust gas test, as a result of the setting of the opening pressure of the ventilation valve 5, as already mentioned. It will furthermore be understood that the ventilation valve 5 has to be embodied such that in the exhaust gas test range (that is, below rpm $n_1$ of FIG. 1*a*) it is substantially tight, in order to avoid the possible setting of an incorrect air/fuel ratio.

Figure 2:
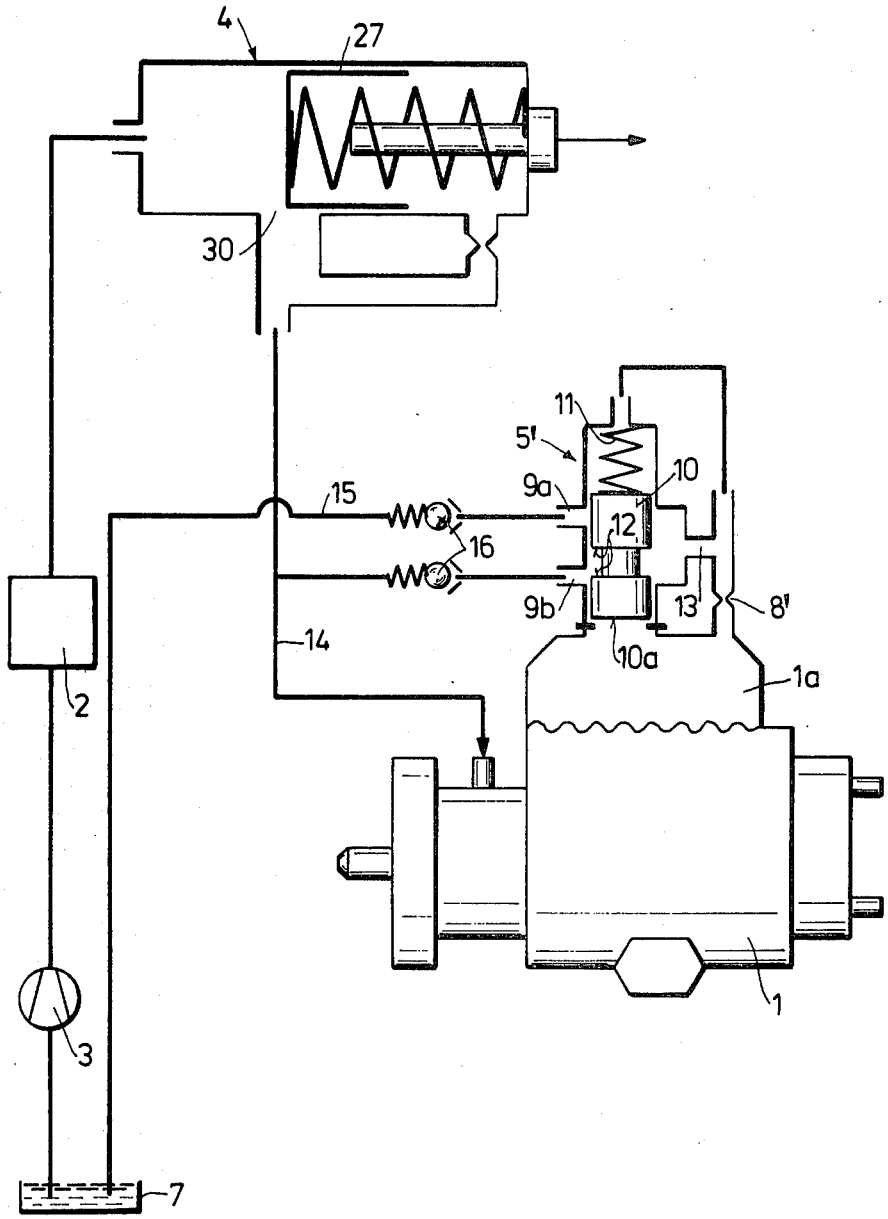
FIG. 2 shows a second exemplary embodiment of the possible ventilation of a fuel injection pump, in schematic form showing two different ventilation positions.

In the exemplary embodiment of FIG. 2, the ventilation valve 5' is embodied as a valve again controlled by the interior injection pump pressure $p_{pi}$, but with two outlets 9*a*, 9*b*, and the pressure control is effected in two stages. The ventilation valve 5' of FIG. 2 has a valve member in the form of a spring-loaded piston 10; the prestressing spring is embodied as a compression spring 11. In accordance with the pump interior pressure already shown in the diagram of FIG. 1*a*, the spring-loaded piston is controlled in accordance with rpm on its piston face 10*a* from the interior 1*a* of the fuel injection pump 1 in such a manner that at low rpm and thus a low pump interior pressure, control edges 12 of the piston 10 switch the discharge line 13 to the pump inlet 14; on the other hand, at high rpm the outlet 9*b* of the ventilation valve 5' is blocked and the outlet 9*a* is opened, connecting the discharge line via a connecting line 15 with the fuel supply container 7. Check valves 16 may be disposed in both outlet lines of the ventilation valve 5'. In the exemplary embodiment of FIG. 2, the ventilation valve 5' is again embodied and adjusted such that within the exhaust gas test range the discharge quantity of the fuel injection pump is returned directly back to the pump downstream of the fuel quantity meter 4, while outside the test range at a correspondingly higher rpm, the discharge quantity reaches the tank. As a result, in the operational states which may in this case be thermally critical, not only is there clean ventilation of the pump but effective cooling is achieved as well. The control of the exhaust gas recirculation system may be effected in the same manner as has been explained for FIG. 1, that is, via a fuel quantity meter. Here again, the fuel quantity meter always measures the total quantity of fuel delivered to the pump inlet; within the exhaust gas test range, this quantity also equals the quantity delivered to the injection valves, but outside the test range the discharge quantity (return flow quantity) is added to it.

Figure 3:
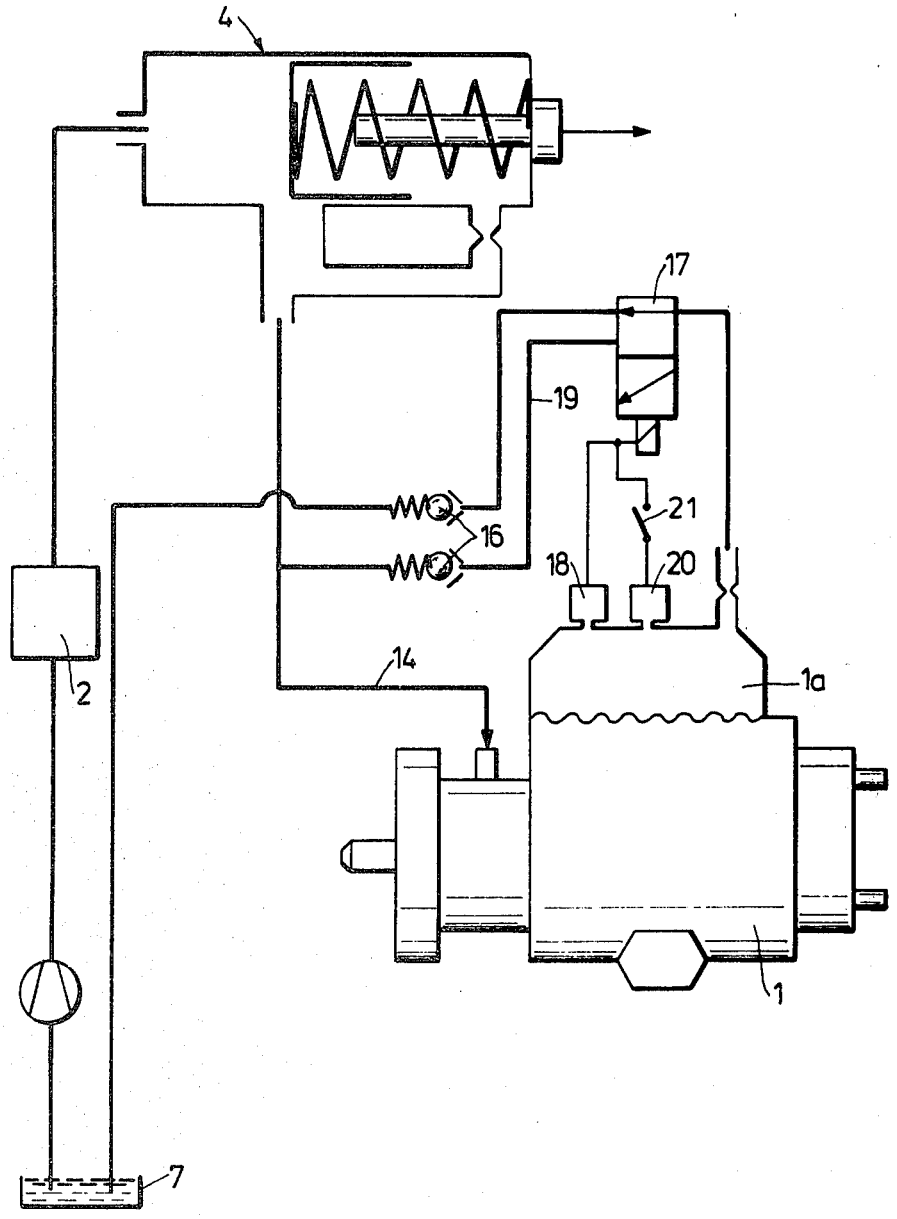
FIG. 3 shows a variant of FIG. 2, having pressure switches controlled by the pump interior pressure and having electrical output variables.

In the exemplary embodiment of FIG. 3, the mechanical ventilation valve is replaced by a magnetic valve 17, as a result of which even peripheral conditions can also be ascertained. In a simplified realization, the magnetic valve may be embodied solely as an actuating magnetic valve which then functions like the ventilation valve 5 of FIG. 1; the actuation of the magnetic valve 17 is effected via a pressure switch 18, which in turn is actuated by the internal pressure of the pump. Above a predetermined internal pump pressure, for example, above the rpm limit resulting from the exhaust gas test range, the magnetic valve 17 then switches the ventilation circuit into operation, with recirculation of the discharge quantity directly back into the fuel supply container 7.

In accordance with a preferred embodiment, however, the magnetic valve is embodied as a switchover magnetic valve, so that below the rpm threshold, the discharge quantity downstream of the fuel quantity meter 4 is again returned to the pump inflow via the connecting line 18, until above the rpm threshold and with effective cooling being switched on, circulation via the fuel supply container 7 is again established upon the response of the pressure switch 18.

In a further embodiment, two pressure switches actuated by the internal pump pressure can also be provided, the second pressure switch being identified as 20. This switch may respond at a substantially lower rpm threshold and open the discharge line to the fuel supply container 7. In this case, however, the second pressure switch is disposed in series with a switch 21 actuated by the driving pedal, and it then serves to effect additional ventilation via the fuel supply container 7 during overrunning above idling rpm. Since the magnetic valve 17 can be switched on electrically, it is also possible for it to switch on when the starter is actuated, for instance, and if need be it may also be switched on by means of a thermal switch (not shown) during starting and while the engine is still cold, so that in these operational states as well, a switchover can be made to ventilation via the fuel supply container 7.

Finally, a further advantageous embodiment of the present invention provides for the compensation of nonlinearities on the part of the fuel quantity meter, caused perhaps by spring stiffness and by the travel receptor; this compensation is effected by embodying the slit 30 as non-rectangular, with a variable width, so that given equal changes in travel distance by the piston, unequal, progressively increasing or decreasing opening cross sections are attained for the passage of fuel through the variable slit 30.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection apparatus for internal combustion engines having a fuel injection pump which includes a predetermined interior pressure for supplying a regulatable fuel injection quantity, a ventilation apparatus for the fuel injection pump and an exhaust gas recirculation means controlled by said fuel quantity, characterized in that a spring-loaded piston-type fuel quantity meter of a mixture regulator is disposed in an inlet to the fuel injection pump, said mixture regulator having a piston the position of which, determined by the fuel quantity at a particular time, is ascertained by a travel receptor, said travel receptor arranged to determine the exhaust gas quantity recirculated to an intake tube, further that disposed in a discharge of said injection pump is a pressure-controlled ventilation valve, which communicates with a heat exchanger, said valve arranged to be controlled by pump interior pressure ($p_{pi}$) and adjusted such that its pressure effecting the opening ($p_{\ddot{o}}$) is greater than the maximum interior pressure of said injection pump in an exhaust gas test range.

2. A fuel supply apparatus as defined by claim 1, characterized in that said heat exchanger is embodied by a fuel supply container.

3. A fuel supply apparatus as defined by claim 1 or 2, characterized in that said fuel quantity meter further includes a cylinder and together with said piston which is slidably supported therein forms a work pressure chamber, said cylinder having an outlet slit of variable width disposed between said cylinder and said piston and further said travel receptor being embodied as a travel-to-voltage converter, said receptor having an electrical output signal arranged to be switched to a control member of said exhaust gas recirculation means for adjusting the quantity of exhaust gas recirculated at a predetermined time.

4. A fuel supply apparatus as defined by claim 2, characterized in that said ventilation valve of said injection pump comprises a two-way valve, having a spring-loaded piston controlled by said pump interior pressure ($p_{pi}$) and arranged to selectively open one of several outlet openings, wherein at a pump interior pressure which corresponds to an engine rpm located within said exhaust gas test range, a discharge line downstream of said fuel quantity meter to the pump inlet is opened, while at a pump interior pressure which corresponds to an rpm beyond said exhaust gas test range, an overflow circuit via said fuel supply container is opened up, for effective cooling and ventilation of said fuel injection pump in predetermined operating ranges.

5. A fuel supply apparatus as defined by claim 2, characterized in that said ventilation valve comprises at least one magnetic valve adaptable to switching by electrical pressure switches, and said at least one pressure switch which controls said magnetic valve is further arranged to be actuated by pump interior pressure.

6. A fuel supply apparatus as defined by claim 5, characterized in that said magnetic valve further comprises a dual operated switchover magnetic valve arranged to open up a discharge line into said pump inlet downstream of said fuel quantity meter, as well as to said discharge line with said fuel supply container.

7. A fuel supply apparatus as defined by claim 5, characterized in that at least one of said pressure switches has a response threshold located at a substantially lower rpm, said at least one pressure switch being in series with a further switch arranged to be controlled by a driving pedal such that during overrunning above the idling rpm, an additional ventilation is possible via said fuel supply container.

8. A fuel supply apparatus as defined by claim 6, characterized in that said magnetic valve is arranged to communicate with said discharge line upon the actuation of a starter and further by means of a thermal switch operable upon starting and when the engine is still cold, in order to form a ventilation circuit via said fuel supply container.

9. A fuel supply apparatus as defined by claim 3, characterized in that said slit of variable width located between said slidably supported piston and said cylinder opening has an arbitrary contour which deviates in shape from the rectangular, whereby nonlinearieties at said fuel quantity meter as well as its associated travel receptor may be compensated for.

* * * * *